United States Patent [19]

Coopmans

[11] Patent Number: 4,667,822

[45] Date of Patent: May 26, 1987

[54] TOOL CADDY

[76] Inventor: George J. Coopmans, 115 E. 26th St., Holland, Mich. 49423

[21] Appl. No.: 813,847

[22] Filed: Dec. 27, 1985

[51] Int. Cl.[4] ..... B65D 85/20

[52] U.S. Cl. ..... 206/373; 206/223; 206/488; 206/509; 312/117; 312/348; 312/DIG. 33; 211/60.1; 211/70.1; 211/70.8

[58] Field of Search ..... 206/373, 223, 372, 377, 206/376, 488, 489, 490, 509; 312/DIG. 33, 348, 333, 117; 211/60.1, 69, 70.1, 70.8

[56] References Cited

U.S. PATENT DOCUMENTS

| | | | |
|---|---|---|---|
| 1,021,998 | 4/1912 | Myers | 206/443 |
| 2,559,636 | 7/1951 | King et al. | 211/60.1 |
| 2,815,853 | 12/1957 | Larson | 211/70.1 |
| 2,826,333 | 3/1958 | Rodemich | 206/509 |
| 2,829,779 | 4/1958 | Carabet | 211/70.1 |
| 3,796,474 | 3/1974 | Noreman et al. | 312/348 |
| 4,273,394 | 6/1981 | Chandler | 206/373 |
| 4,285,558 | 8/1981 | Medford | 312/117 |
| 4,303,158 | 12/1981 | Perkins | 206/373 |
| 4,458,963 | 7/1984 | Keddie | 312/DIG. 33 |
| 4,460,085 | 7/1984 | Jantzen | 206/373 |

*Primary Examiner*—William Price
*Assistant Examiner*—Brenda J. Ehrhardt
*Attorney, Agent, or Firm*—John A. Waters

[57] ABSTRACT

Replaceable panels with small openings for locating tools are positioned in a horizontal plane by guideways in the housing of a tool caddy. Vertical partition panels are secured by the horizontal panels, which are locked in place by pins engaging the housing. The entrance to the horizontal guideways is accessible at the back of the housing.

4 Claims, 10 Drawing Figures

TOOL CADDY

BACKGROUND OF THE INVENTION

Several types of containers are in general use for the storage of tools. One of these is the usual tool box, which is a closeable structure with a hinged lid, usually provided with drawers and trays of various sizes. Both the drawers and the trays are commonly provided with a vertical-plane separating panels to establish compartments for tools and equipment of various sizes. Another type of container is commonly referred to as a "tool caddy", which is usually a case providing an open rack for the storage of tools in a readily-available position, rather than in a random assortment laid flat in a drawer or tray. The tool caddy will present the tools in an instantly-recognizable array, usually in a vertical position from which the tools can be withdrawn as needed. To provide this feature, the tool caddy usually has horizontal panels provided with openings adapted to receive particular tools, usually in related groups. The problem here is that the needs of each mechanic reflect his own particular type of work and work procedures, and it is difficult, if not impossible, to design one tool caddy that will exactly suit the needs of more than one user. These containers are usually adapted to be either placed on a bench top, hung on a wall, or carried by hand to the job site. Particularly in the latter case, it is extremely important that the unit be adapted to the needs of the particular user.

SUMMARY OF THE INVENTION

The housing structure of a tool caddy is provided with openings in the upper surface, and with guideways extending across the space below these openings. Certain of the guideways receive tool-positioning panels in a generally horizontal plane, the entrance to these guideways being accessible at the back of the housing. Guideways in a vertical plane receive partition panels terminating below the horizontal panels. Pins traversing portions of the housing intersect the horizontal panels to lock the entire panel system in position.

DESCRIPTION OF THE PREFERRED EMBODIMENT

Figure 1:
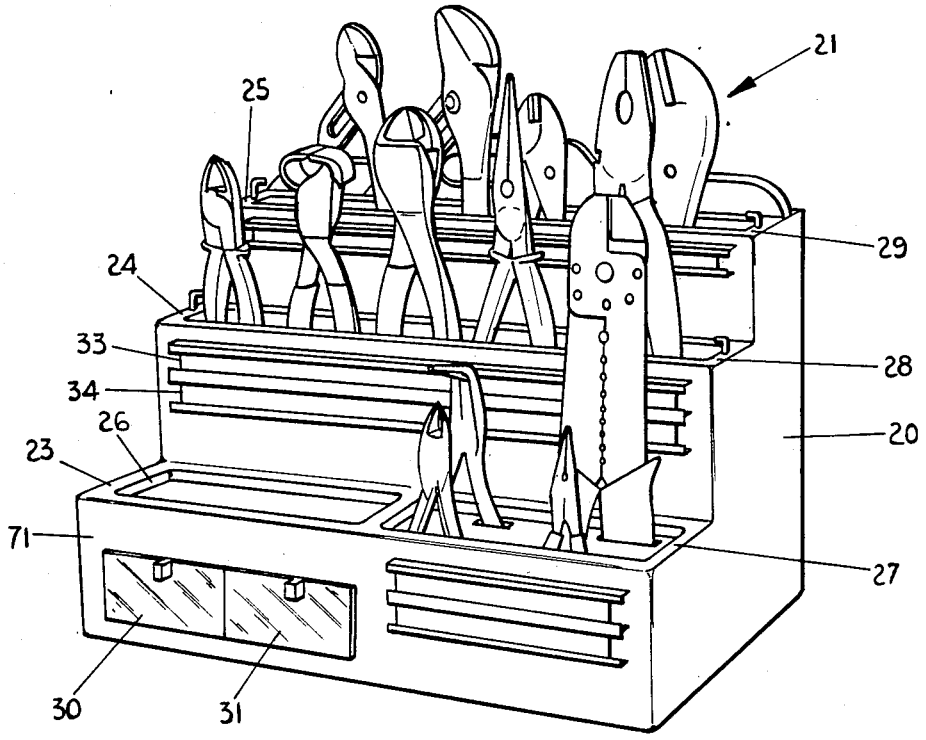
FIG. 1 is a perspective view of a tool caddy embodying the present invention, showing a typical variety of tools that may be accommodated by a selected arrangement.
Figure 2:
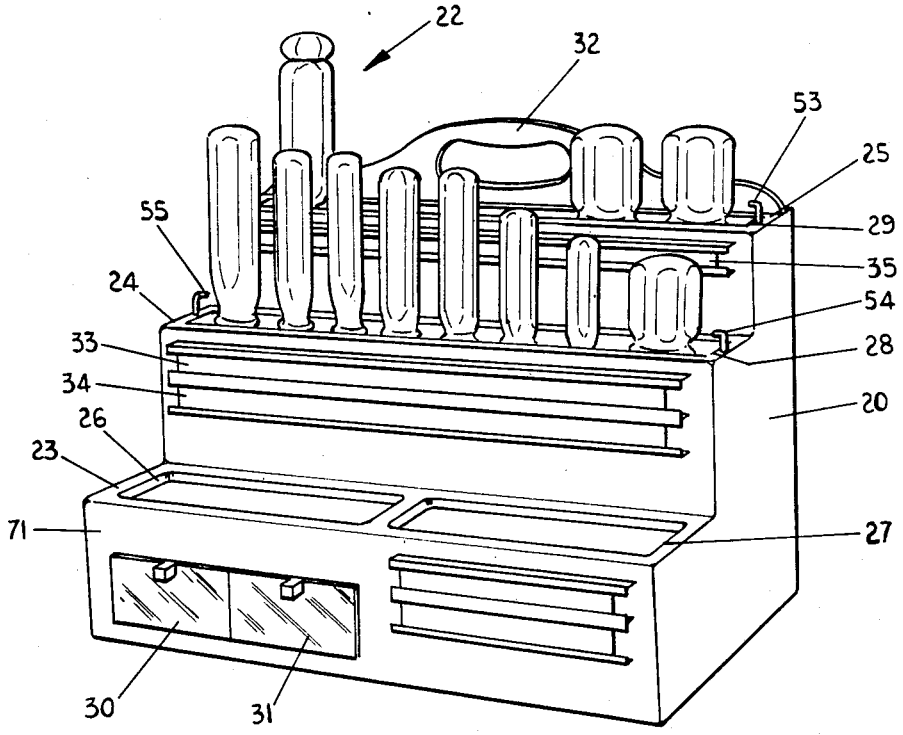
FIG. 2 is a perspective view of the same device illustrated in FIG. 1, but equipped with a different set of locating plates for accommodating a different group of tools.

The tool caddy shown in FIGS. 1 and 2 has a housing generally indicated at 20. In FIG. 1, the device is shown arranged to accommodate a group of pliers of various configurations. These are indicated generally at 21. In FIG. 2, the device has been adapted to receive a group of screwdrivers indicated at 22. The housing of the device has a stepped configuration providing horizontal surfaces at levels indicated at 23–25. Each of these horizontal surfaces has relatively large openings as shown at 26–29. Drawers as shown at 30 and 31 are provided in the lower front of the housing. A handle 32 is preferably incorporated in the housing near the back to facilitate using the tool caddy at the site on which the work is being performed. Replaceable identification strips as indicated at 33–35 may be used to identify the various tools in storage in the device. This is particularly useful in cases where the characteristics of the tool are concealed by the housing.

Figure 3:
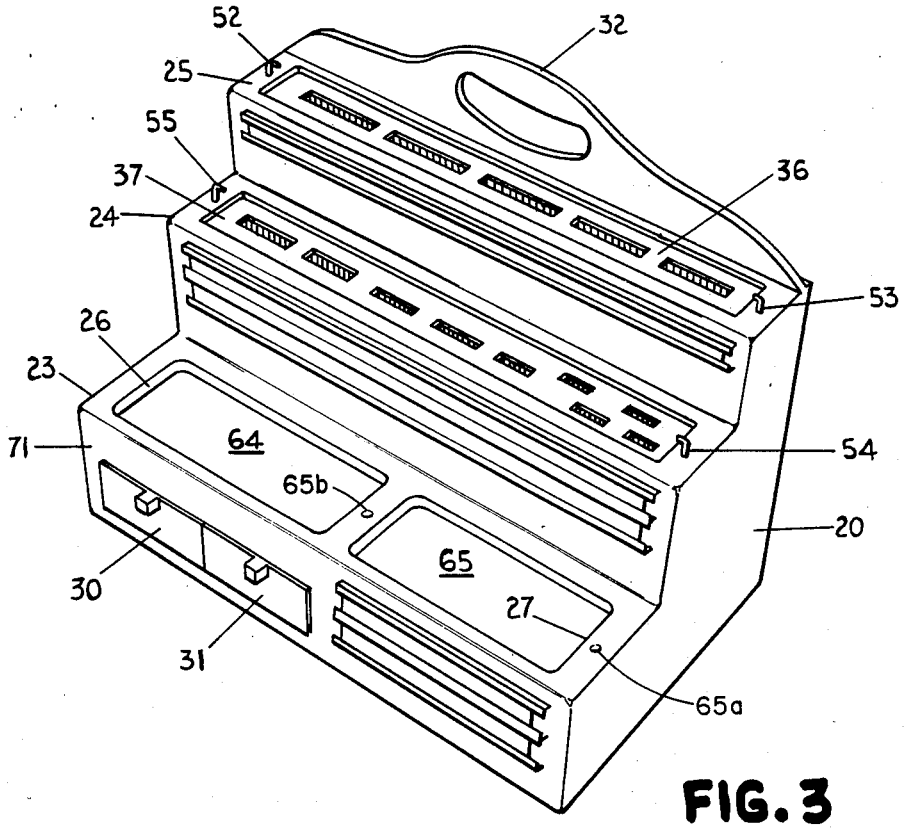
FIG. 3 is a perspective view of the device shown in FIG. 1, without the presence of any of the tools.
Figure 5:
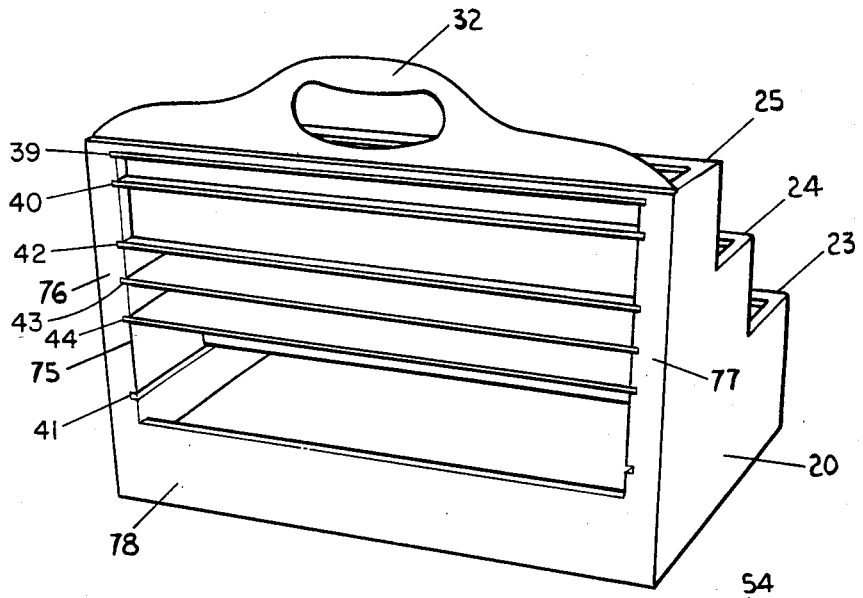
FIG. 5 is a rear view of the device shown in FIG. 3.
Figure 6:
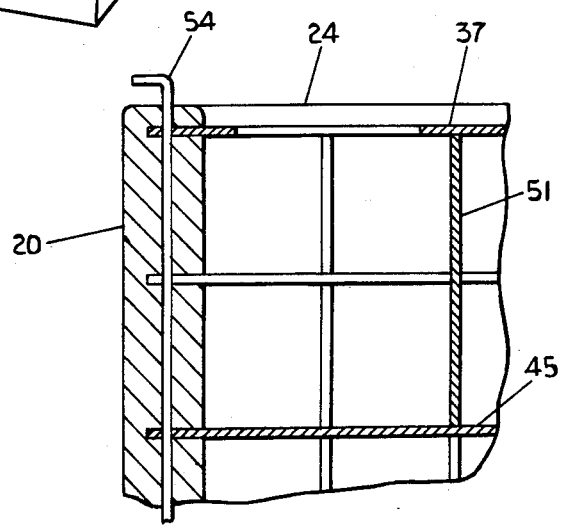
FIG. 6 is an enlarged sectional elevation at a corner of the device, showing the pattern of intersecting guideways.
Figure 7:
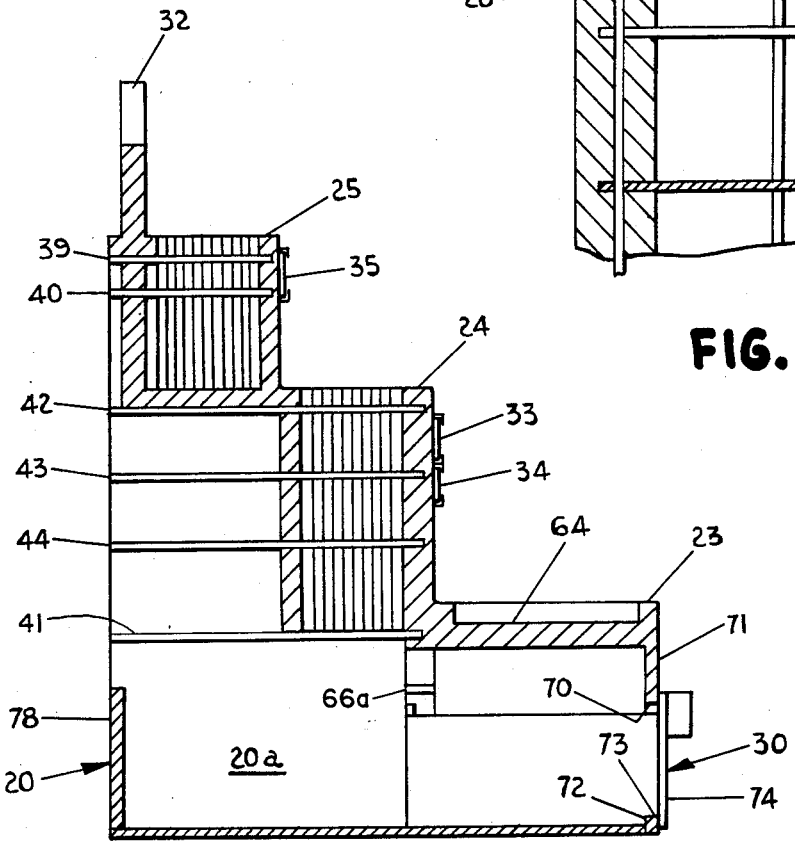
FIG. 7 is a central sectional elevation taken through one of the drawers.
Figure 8:
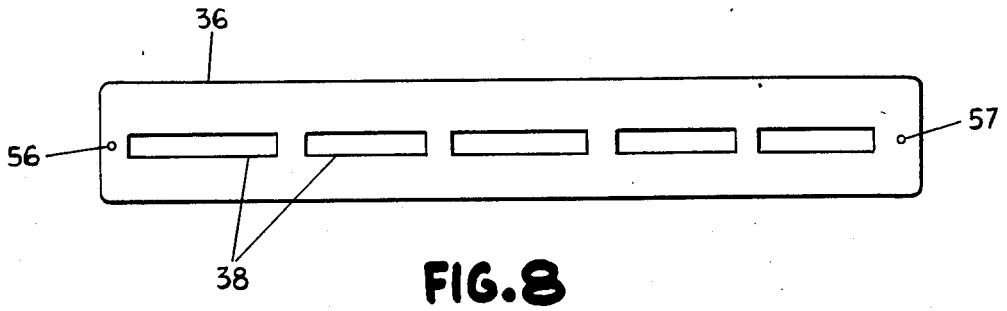
FIG. 8 is an enlarged plan view of one of the locating plates.
Figure 9:
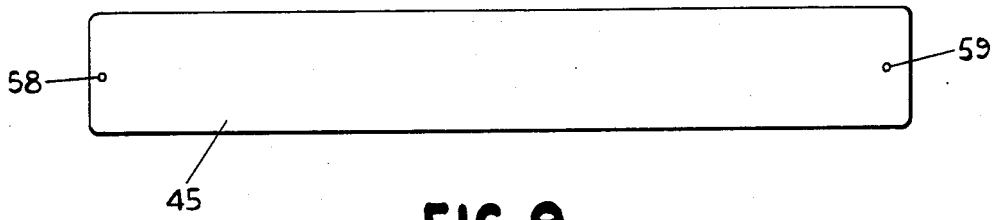
FIG. 9 is a view on the same scale as that of FIG. 8, showing an imperforate plate that can function as a compartment floor.

Referring to FIG. 3, the arrangement for accommodating the various types of tools centers in the replaceable horizontal locating plates indicated at 36 and 37. One of these is shown in FIG. 8. Each of them has a group of relatively small openings shown at 38 for receiving the handle ends of the pliers appearing in FIG. 1. These plates are received in horizontal guideways as best shown in FIG. 7. These guideways are provided by the grooves 39–44 in the walls of the housing, and extend across the space below the relatively large openings 28 and 29 in the horizontal surfaces of the housing. Any of these guideways may also be used to receive an imperforate plate 45 as shown in FIG. 9 to form a floor to the space, limiting the depth of penetration of the various tools through the openings 38. The horizontal guideways 39–44 are all accessible for the insertion of the plates at the back of the housing, and an assortment of locating plates and imperforate plates may be stored (along with other tools and equipment), if desired, in the bin space **20*a* in FIG. 7. The plates may be just wide enough to extend across the space below the relatively large openings, or they may be of sufficient depth to extend all the way to the back of the housing, as shown in FIG. 5**. In the latter case, the plates are more readily accessible for insertion and removable, but require a correspondingly greater amount of material.

Figure 4:
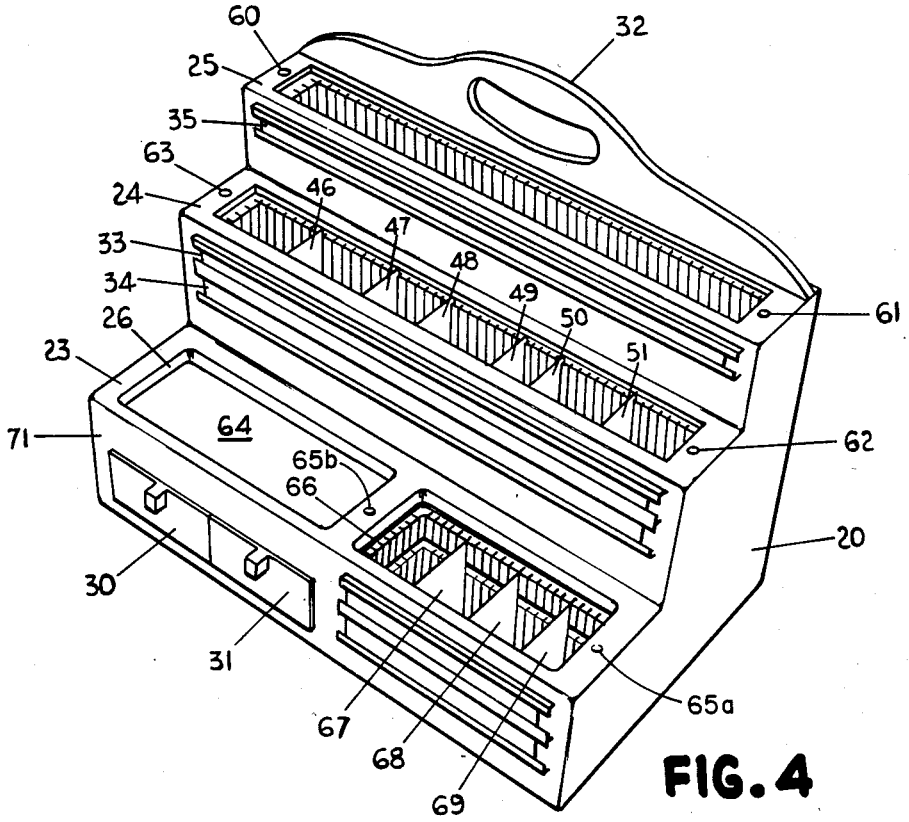
FIG. 4 is a view similar to FIG. 3, but with the horizontal locating plates removed to expose the interior guideways.

The spaces below the relatively large openings 28 and 29 are also traversed by vertical guideways for receiving partition panels as shown at 46–51 in FIG. 4 in selected positions. These partition panels terminate below the level of the horizontal panels 36 and 37, and are thus locked in position by the insertion of the horizontal panels. The vertical guideways are terminated by a floor panel in the guideway 41 as shown in FIG. 7, and thus are completely confined. The locking system is completed by the insertion of the angular pins 52–55, which traverse holes as shown at 56–59 in FIGS. 8 and 9, and are received in the holes 60–63, respectively, in the housing, referring to FIG. 4. In the illustrated structure, the large opening 26 in the lower level 23 surrounds a fixed floor 64 to provide a tray. At the lower right corner of FIG. 3, a non-perforate panel 65 is received in the guideway 66 to form the floor of another tray. This panel, however, can be removed to expose the space below, which is separated by the vertical partition panels 67–69. These can be used as storage bins for small items that may be required less frequently. The floor panel 65 may, if desired, be secured by pins (not shown) inserted in the holes 65*a* and 65*b* in the same manner as the panels 36 and 37 shown in FIG. 3. Additional horizontal guideways below the guideway 66 can be used for either perforated or unperforated panels. One such guideway is indicated at 66*a* in FIG. 7 beyond the drawer.

Referring to FIG. 7, the drawer 30 is received in the opening 70 in the front wall 71 of the housing. The lower front portion of the drawer is offset at 72 to interengage with the ledge 73 defining the lower edge of the drawer opening. The height of the opening 70 is sufficient to accept the full height of the drawer 30, together with the added height of the ledge 73, so that the drawer may be lifted over the ledge and removed. The height of the front panel 74 of the door is sufficient to completely cover the opening 70 to prevent the accidental emergence of the contents.

Referring to FIG. 5, the back of the housing 20 is preferably left open, as shown at 75. This opening is defined by the marginal pieces 76 and 77, and the lower beam 78 is provided along the bottom for structural integrity.

Figure 10:
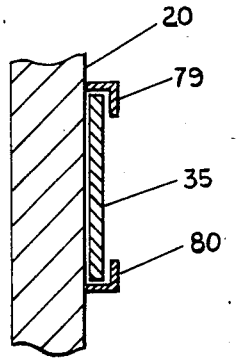
FIG. 10 is a fragmentary enlarged sectional view showing a guideway for receiving an identification strip.

Referring to FIG. 10, the labeling strips are retained by guideways formed by the angle-shaped members 79 and 80 secured adhesively, or otherwise, to a wall of the housing 20. The strips are slipped end wise into these guideways, and are easily removed for re-labeling.

I claim:

1. A tool caddy having a housing and means providing openings for receiving portions of particular tools, wherein the improvement comprises:

a plurality of substantially horizontal panels on said housing each having a relatively large opening, said panels forming a stepped configuration from lower to higher from front to rear;

guideway means disposed in a substantially horizontal plane and accessible from the rear of said housing and extending to a position below each of said relatively large openings; and a plurality of locating plates each having relatively small openings, said plates being receivable in said guideway means, respectively, to occupy an area directly below said relatively large openings.

2. A tool caddy as defined in claim 1, additionally including vertical guideway means fixed with respect to said housing on opposite sides of at least one of said relatively large openings, and at least one partition plate receivable in said vertical guideway means and extending across the space defined by the vertically-projected area of said one relatively large opening, said partition plate having the upper edge thereof disposed below said locating plate.

3. A tool caddy as defined in claim 1, wherein said housing and locating plate have aligned holes adjacent the periphery of said relatively large openings, and additionally including removable pin means traversing said holes to lock said locating plates in position in said housing.

4. A tool caddy as defined in claim 1, including a plurality of guideway means disposed in vertically spaced horizontal planes below said first-mentioned guideway means, respectively, and also including at least one imperforate plate receivable in one of said guideway means to form a floor above said imperforate plate.

* * * * *